US006701947B1

(12) United States Patent
Ramos

(10) Patent No.: US 6,701,947 B1
(45) Date of Patent: Mar. 9, 2004

(54) WET UMBRELLA CARRYING BAG

(76) Inventor: Delila Ramos, 444 2nd Ave. #21G, New York, NY (US) 10010

( * ) Notice: Subject to any disclaimer, the term of this patent is extended or adjusted under 35 U.S.C. 154(b) by 0 days.

(21) Appl. No.: 10/015,233

(22) Filed: Dec. 12, 2001

(51) Int. Cl.[7] ..... A45B 15/00
(52) U.S. Cl. ..... 135/34.2
(58) Field of Search ..... 135/34.2; 383/75, 383/113; 150/154; 224/915

(56) References Cited

U.S. PATENT DOCUMENTS

| | | | | | |
|---|---|---|---|---|---|
| 442,991 | A | * | 12/1890 | McKevit | 135/34.2 |
| 1,904,510 | A | * | 4/1933 | Mott | 135/34.2 |
| 2,522,604 | A | * | 9/1950 | Courter | 135/34.2 |
| 4,991,245 | A | * | 2/1991 | Franco | 5/419 |
| 5,159,999 | A | * | 11/1992 | Voigt | 190/111 |
| 5,323,802 | A | * | 6/1994 | Kiedrowski | 135/34.2 |
| 5,839,298 | A | * | 11/1998 | Duquet | 68/17 R |
| 6,378,581 | B1 | * | 4/2002 | Sheridan et al. | 150/159 |

FOREIGN PATENT DOCUMENTS

| | | | | |
|---|---|---|---|---|
| DE | 3524855 | * | 12/1985 | 135/34.2 |
| IT | 703128 | * | 4/1966 | 135/34.2 |
| JP | 5921215 | * | 2/1984 | 135/34.2 |
| JP | 401107702 | * | 4/1989 | |
| JP | 408112125 | * | 5/1996 | |

* cited by examiner

*Primary Examiner*—Janet M. Wilkens
(74) *Attorney, Agent, or Firm*—Goldstein Law Offices, PC

(57) ABSTRACT

A wet umbrella carrying bag that allows a wet umbrella to be stored so that water will be collected for later disposal and not dampen floor areas including a collapsible bag portion dimensioned for receiving an umbrella therein. The collapsible bag portion has an open upper end and an open lower end. A collection tray is secured to the open lower end of the collapsible bag portion. The collection tray has an open upper end and an open lower end. The open upper end is secured to the open lower end of the collapsible bag portion. The open narrow lower end has an adjustable drain disposed therein for selectively draining water from within the collection tray.

4 Claims, 3 Drawing Sheets

16
20
24
12
18
26
32
30

WET UMBRELLA CARRYING BAG

BACKGROUND OF THE INVENTION

The invention relates to a wet umbrella carrying bag that allows a wet umbrella to be stored so that water will be collected for later disposal and not dampen floor areas.

The problem with umbrellas is the resulting dripping of water off of the umbrella once a person is inside a house or building and out of the rain. Typically, the person will collapse the umbrella and place it on the floor or carry it with them. The problem with this is the eventual accumulation of water on the floor area. This can often lead to other people slipping on these "watery areas" and becoming injured or wet. What is needed is a device that will prevent water from dripping off of wet umbrellas. becoming injured or wet. What is needed is a device that will prevent water from dripping off of wet umbrellas.

The present invention attempts to solve the abovementioned problem by providing a wet umbrella carrying bag that allows a wet umbrella to be stored so that water will be collected for later disposal and not dampen floor areas.

Several references show various protective cover devices. U.S. Pat. No. 5,323,802 to Kiedrowski discloses an umbrella bag comprised of an inner later of water-absorbing material and an outer layer of air-permeable material to allow for evaporation. U.S. Pat. No. 2,522,604 to Courtner discloses a flexible container for holding one or more umbrellas. U.S. Pat. No. 2,373,471 to Hannan discloses an umbrella holding device.

While these units may be suitable for the particular purpose employed, or for general use, they would not be as suitable for the purposes of the present invention as disclosed hereafter.

SUMMARY OF THE INVENTION

It is an object of the invention to produce a wet umbrella carrying bag that allows a wet umbrella to be stored so that water will be collected for later disposal and not dampen floor areas including a collapsible bag portion dimensioned for receiving an umbrella therein. The collapsible bag portion has an open upper end and an open lower end. The open upper end has an incorporated drawstring to facilitate closure of the open upper end. The collapsible bag portion includes an internal spring disposed interiorly thereof. The spring extends between the open upper and lower ends. The collapsible bag portion has a carrying strap extending between the open upper and lower ends thereof. A conical collection tray is secured to the open lower end of the collapsible bag portion. The collection tray has an open wide upper end and an open narrow lower end. The open wide upper end is secured to the open lower end of the collapsible bag portion. The open narrow lower end has an adjustable drain disposed therein for selectively draining water from within the collection tray.

To the accomplishment of the above and related objects the invention may be embodied in the form illustrated in the accompanying drawings. Attention is called to the fact, however, that the drawings are illustrative only. Variations are contemplated as being part of the invention, limited only by the scope of the claims.

BRIEF DESCRIPTION OF THE DRAWINGS

In the drawings, like elements are depicted by like reference numerals. The drawings are briefly described as follows.

DETAILED DESCRIPTION OF THE PREFERRED EMBODIMENTS

It will be noted in the various figures that the device relates to a wet umbrella carrying bag that allows a wet umbrella to be stored so that water will be collected for later disposal and not dampen floor areas. In its broadest context, the device consists of a collapsible bag portion and a conical collection tray. Such components are individually configured and correlated with respect to each other so as to attain the desired objective.

Figure 1:
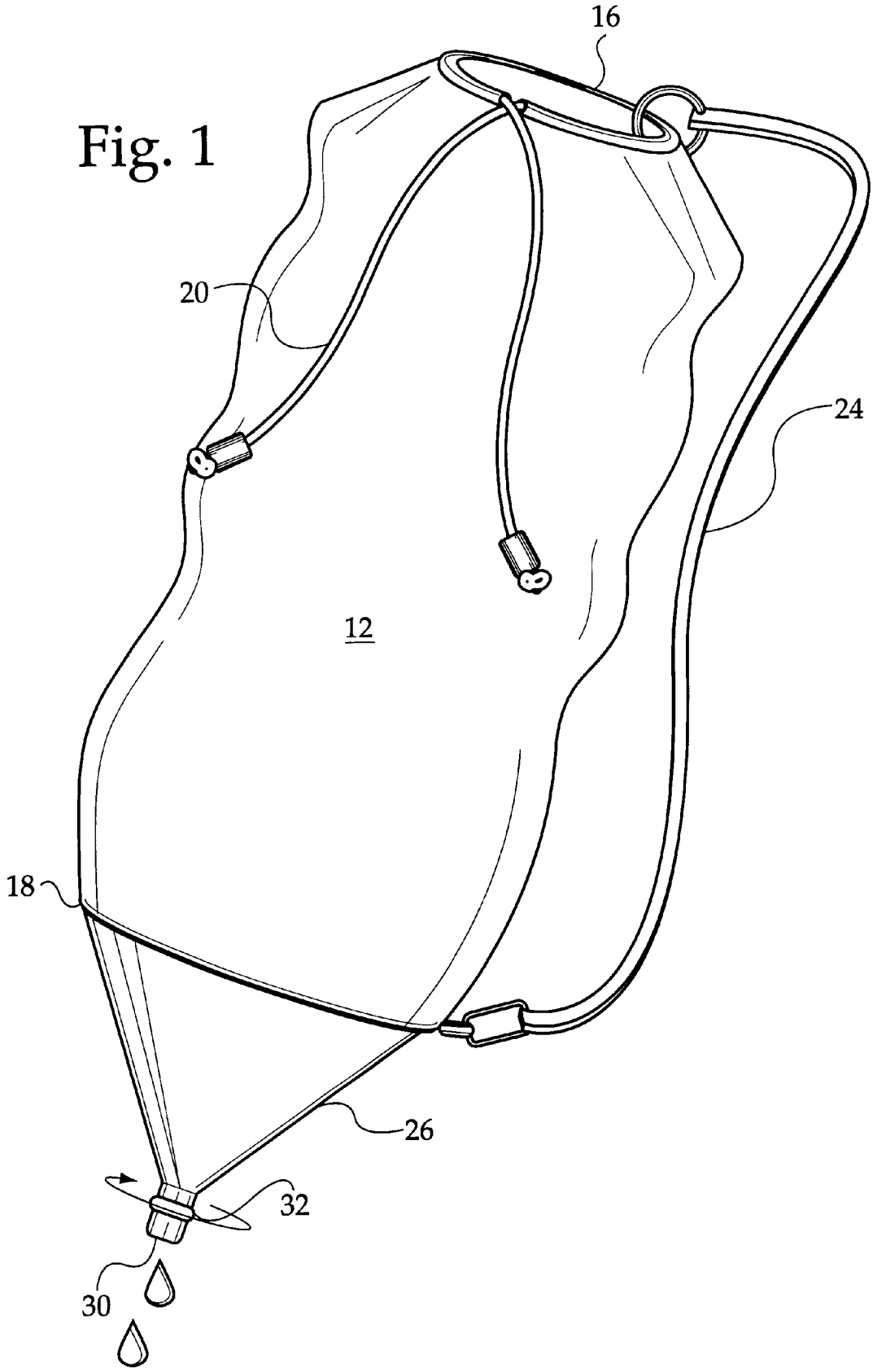
FIG. 1 is a plan perspective view of the present invention.
Figure 2:
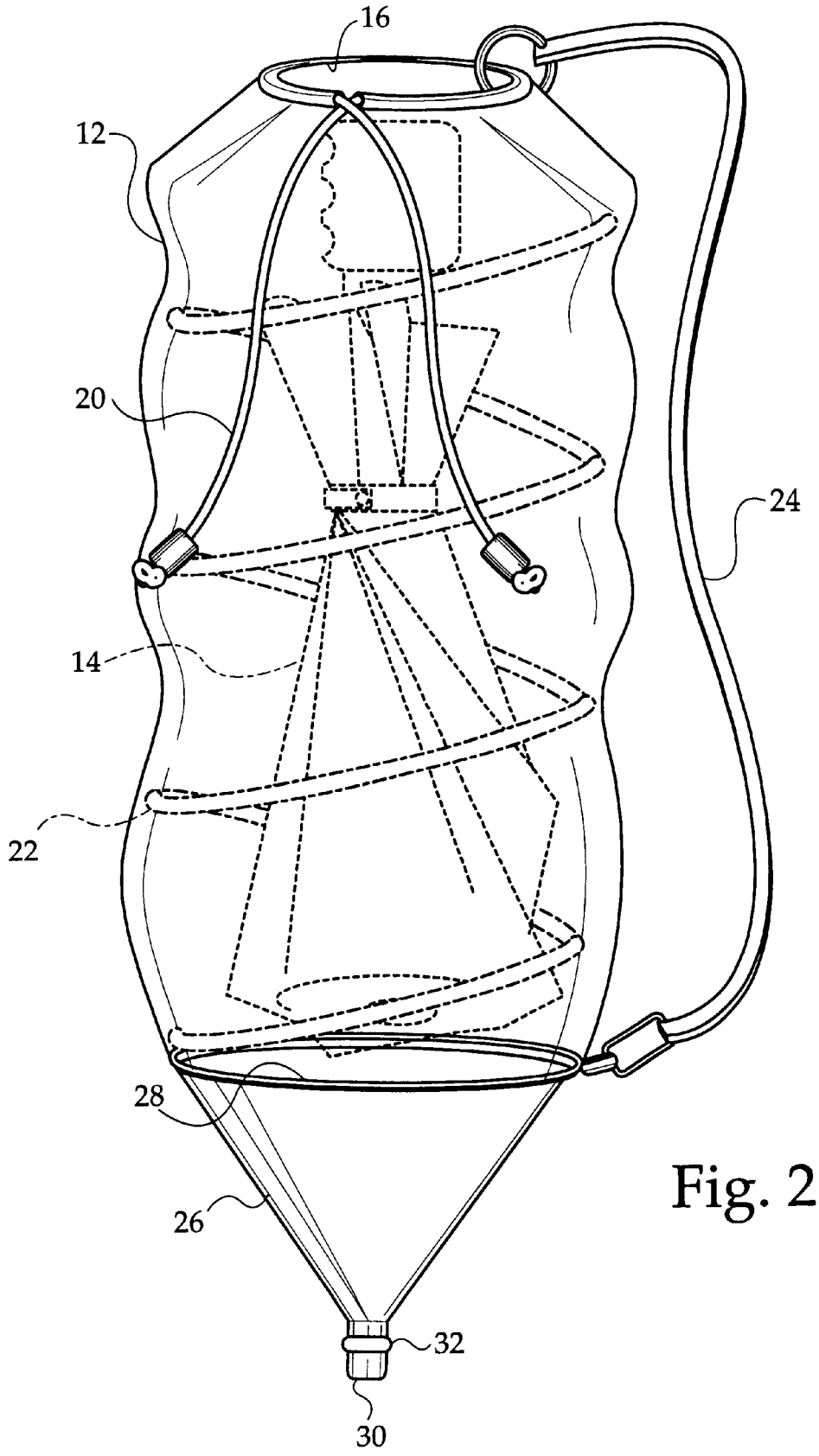
FIG. 2 is a plan perspective view of the present invention illustrated in use.
Figure 4:
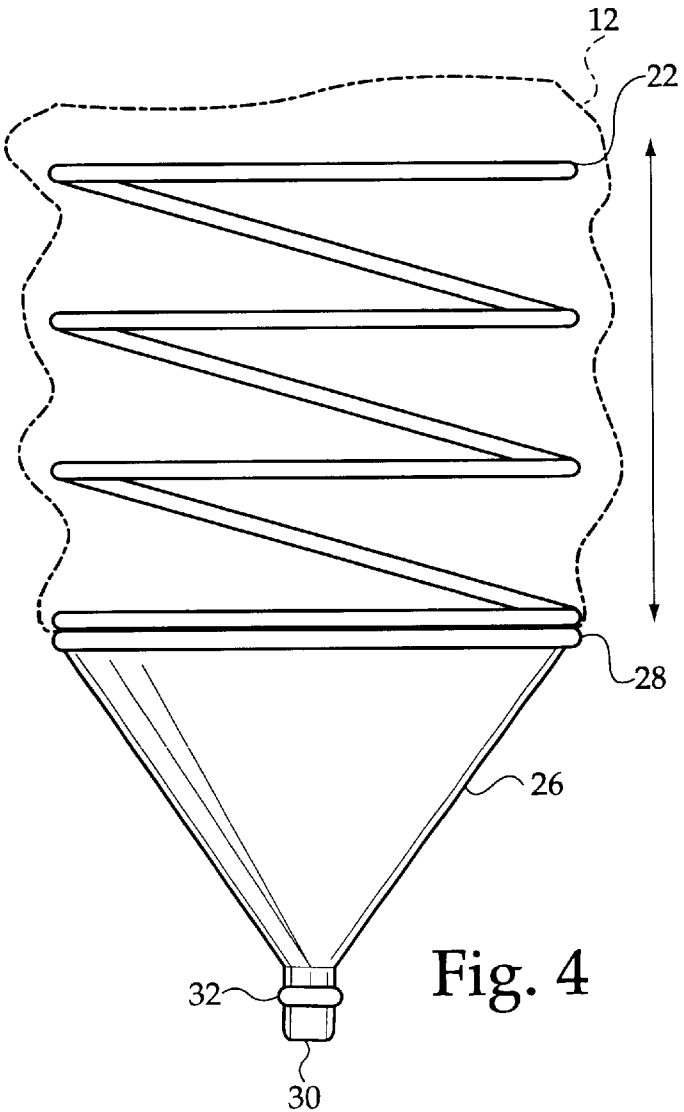
FIG. 4 is a partial side view of the present invention illustrating an interior spring thereof in an extended orientation.
Figure 3:
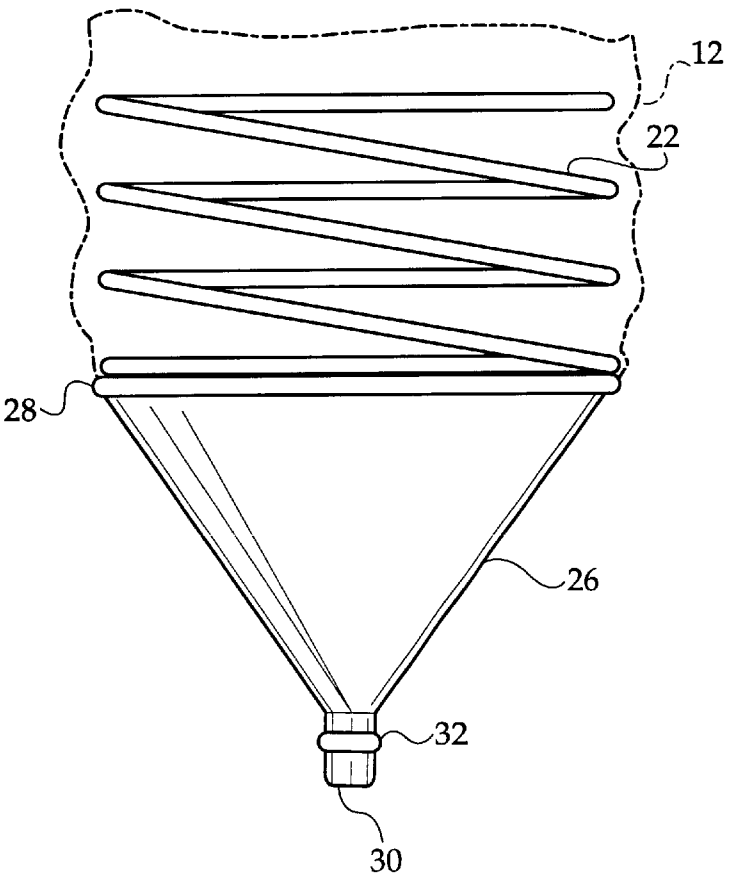
FIG. 3 is a partial side view of the present invention illustrating an interior spring thereof in a collapsed orientation.

The collapsible bag portion 12 is dimensioned for receiving an umbrella 14 therein. Note FIGS. 1 and 2. The collapsible bag portion 12 has an open upper end 16 and an open lower end 18. The open upper end 16 has an incorporated drawstring 20 to facilitate closure of the open upper end 16. The collapsible bag portion 12 includes an internal spring 22 disposed interiorly thereof. The spring 22 extends between the open upper and lower ends 16,18. The spring 22 can be easily expanded and compressed to facilitate longitudinal extension and collapsing of the bag portion 12 between the upper and lower ends 16, 18. Note FIGS. 3 and 4. The collapsible bag portion 12 has a carrying strap 24 extending between the open upper and lower ends 16,18 thereof. The carrying strap can be removable with respect to the bag portion 12. It is important to note that the bag portion 12 is constructed of a non-porous material to prevent the leakage of water therefrom. that the bag portion 12 is constructed of a non-porous material to prevent the leakage of water therefrom.

The conical collection tray 26 is secured to the open lower end 18 of the collapsible bag portion 12. The collection tray 26 has an open wide upper end 28 and an open narrow lower end 30. The open wide upper end 28 is secured to the open lower end 18 of the collapsible bag portion 12. The open narrow lower end 30 has an adjustable drain 32 disposed therein for selectively draining water from within the collection tray 26. Once water has accumulated within the collection tray 26 and the user reaches an area where they can safely drain the water, the adjustable drain 32 is opened to allow the water to exit through the open narrow lower end 30.

What is claimed is:

1. A wet umbrella carrying bag that allows a wet umbrella to be stored so that water will be collected for later disposal and not dampen floor areas, comprising, in combination:

a collapsible bag portion dimensioned for receiving an umbrella therein, the collapsible bag portion having an open upper end and an open lower end, the open upper end having an incorporated drawstring to facilitate closure of the open upper end, the collapsible bag portion including an internal spring disposed interiorly thereof, the spring extending between the open upper and lower ends for facilitating longitudinal extension and collapsing of the bag between the upper and lower end, the collapsible bag portion having a carrying strap extending between the open upper and lower ends thereof; and a conical collection tray secured to the open lower end of the collapsible bag portion, the collection tray having an open wide upper end and an open narrow lower end, the open wide upper end secured to the open lower end of the collapsible bag portion, the open narrow lower end having an adjustable drain disposed therein for selectively draining water from within the collection tray.

2. A wet umbrella carrying bag that allows a wet umbrella to be stored so that water will be collected for later disposal and not dampen floor areas, comprising, in combination:

a collapsible bag portion dimensioned for receiving an umbrella therein, the collapsible bag portion having an open upper end and an open lower end, the bag portion collapsible longitudinally between the upper end an lower end, said collapsible bag portion further having an internal spring disposed interiorly thereof, the spring extending between the open upper and lower ends; and a collection tray secured to the open lower end of the collapsible bag portion, the collection tray having an open upper end and an open lower end, the open upper end secured to the open lower end of the collapsible bag portion, the open lower end having an adjustable drain disposed therein for selectively draining water from within the collection tray.

3. The wet umbrella carrying bag as set forth in claim 2, wherein the open upper end of the collapsible bag portion has an incorporated drawstring to facilitate closure of the open upper end.

4. The wet umbrella carrying bag as set forth in claim 2, wherein the collapsible bag portion has a carrying strap extending between the open upper and lower ends thereof.

* * * * *